United States Patent [19]

Koyama et al.

[11] Patent Number: 4,566,299

[45] Date of Patent: Jan. 28, 1986

[54] CONTROL METHOD AND APPARATUS FOR ROLLING MILL

[75] Inventors: Hiroshi Koyama, Hitachi; Keiji Saito, Katsuta, both of Japan

[73] Assignee: Hitachi, Ltd., Tokyo, Japan

[21] Appl. No.: 625,592

[22] Filed: Jun. 28, 1984

[30] Foreign Application Priority Data

Jun. 29, 1983 [JP] Japan ..... 58-115908

[51] Int. Cl.[4] ..... B21B 37/00

[52] U.S. Cl. ..... 72/8; 72/16; 72/17; 72/19; 72/249

[58] Field of Search ..... 72/249, 19, 8, 17, 16

[56] References Cited

U.S. PATENT DOCUMENTS 4,145,901 3/1979 Imai et al. ..... 72/8
4,145,902 3/1979 Imai et al. ..... 72/8
4,365,496 12/1982 Shiozaki et al. ..... 72/249

FOREIGN PATENT DOCUMENTS 0046162 4/1979 Japan ..... 72/249

*Primary Examiner*—Francis S. Husar
*Assistant Examiner*—Steven B. Katz
*Attorney, Agent, or Firm*—Antonelli, Terry & Wands

[57] ABSTRACT

In a rolling mill having a pair of upper and lower work rolls, defining a pressure gap therebetween through which a material is passed to be rolled, a method and apparatus for controlling the rolling mill under the different peripheral-speed rolling operation in which one of the rolls is driven at a predetermined peripheral speed by controlling the speed of a motor for driving the one roll, and the other roll is controlled to generate a torque corresponding to a difference, between a total torque required for the rolling operation and a torque generated by the one roll by controlling the torque of the motor for driving the other roll on the basis of a torque command corresponding to the torque difference.

6 Claims, 4 Drawing Figures

CONTROL METHOD AND APPARATUS FOR ROLLING MILL

This invention relates to a control method and apparatus for a rolling mill, and particularly to a method and apparatus for controlling a pair of upper and lower work rolls of a rolling mill positively driven at different peripheral speeds.

There are known various methods for rolling a strip material through a pair of upper and lower work rolls of a rolling mill which are driven at different peripheral speeds, as disclosed for example in U.S. Pat. Nos. 4,145,901 and 4,145,902, both issued on Mar. 27, 1979 and entitled "Rolling Mill". According to the above-mentioned rolling method, it is possible to reduce a strip material to a very thin thickness which is hardly obtained by reduction control with work rolls driven at the same speed or to reduce very hard materials such as high-carbon steel or stainless steel to a desired thickness by changing the ratio of the peripheral speeds of work rolls.

In the conventional rolling methods with differential work-roll speed, the peripheral-speed ratio (the ratio of the peripheral speeds of work rolls) is controlled to be kept constant or at a predetermined value. However, the stable region of peripheral speed ratio necessary for stable rolling may be greatly changed by an external disturbance and, therefore, the selected peripheral speed ratio may not always be within the stable region, causing a slip phenomenon and so on.

The rolling is affected not only by the ratio of the peripheral speeds of upper and lower rolls, but also by reduction force, friction coefficient, speed, amount of coolant, forward and backward tensions and so on. If the peripheral-speed ratio is determined without considering these variables and if control is to achieve the determined peripheral-speed ratio, stable rolling will not be expected. Also, it is very difficult to keep the peripheral-speed ratio constant over a wide speed range from low to high speed. Thus, even from this aspect it will be understood that the controlling of the peripheral-speed ratio to be constant is apt to be unstable. That is, when rapidly accelerating the rolling speed from about 1% to 100% of the rated speed in a cold rolling mill, for example, it is very difficult in a practical rolling operation to maintain the peripheral-speed ratio always constant because of the delay in response of the control system, changes due to external disturbance and so on.

Accordingly, it is an object of this invention to provide a method of rolling a material to be rolled, with stability by driving a pair of upper and lower rolls of a rolling mill at different peripheral speeds.

It is another object of this invention to provide an apparatus for carrying out the above-given rolling method.

According to this invention, there are provided a control method and apparatus for a rolling mill wherein one of the upper and lower rolls, for example, the lower roll is driven at a peripheral speed almost the same as the exit side speed of the rolled material, while the speed of the other roll, or the upper roll is controlled so as to make the sum (total torque) of the torques of two motors driving the work rolls equal to a given value. The given value may be a calculated value calculated as a function of various rolling conditions or may be a value determined based on the optimum rolling condition obtained from the results of rolling at the initial stage of the actual rolling operation.

The above and other objects and features of the present invention will be more clearly understood from the following description taken in conjunction with the accompanying drawings in which.

Figure 1:
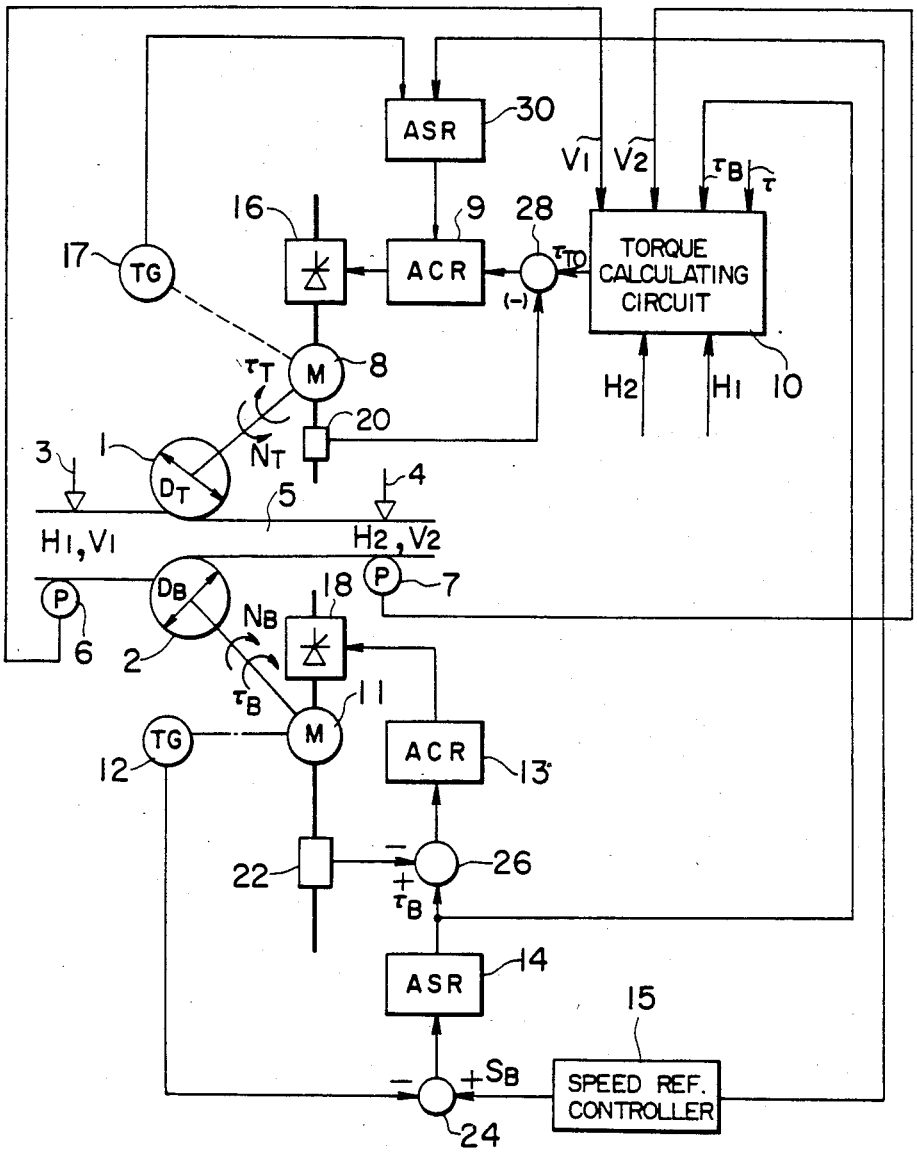
FIG. 1 is a block diagram of an embodiment of control apparatus according to this invention.

An embodiment of this invention will be described with reference to FIG. 1. This invention can be applied to one stand of a single or twin-stand reversing mill or one stand of the tandem mill. Referring to FIG. 1, there are shown a pair of upper and lower work rolls 1 and 2 of such stand, thickness gauges 3 and 4 provided at entry and exit sides thereof, respectively, velocity detectors 6 and 7 for detecting the velocities of the rolled steel at the entry and exit sides, a motor 8 for driving the upper work roll 1, and an automatic current regulator (ACR) 9 for controlling a power supply 16 for driving the motor 8. If the motor 8 is a DC motor, the power supply 16 may be a DC generator controlled by the ACR 9 to generate a variable DC voltage, or the power supply may be a rectifier which is connected to a constant voltage DC power circuit in series with the motor 8 and whose on-duty is controlled by the ACR 9, thereby controlling the effective voltage applied to the motor 8. The motor 8 may be a three-phase induction motor. In that case, the power supply 16 is a variable-frequency inverter for converting the input DC current supplied from the DC power circuit to an AC current, whose frequency is controlled by the ACR 9. For convenience of explanation, it is assumed, in this embodiment, that the motor 8 is a DC motor and the input DC voltage applied thereto from the power supply 16 is controlled by the ACR 9. Also, there are shown a torque calculating circuit 10 which will be described in detail later, a motor 11 for driving the lower work roll 2, a power supply 18 for the motor 11, an automatic current regulator (ACR) 13, and an automatic speed regulator (ASR) 14. The motor 11 and power supply 18 are similar to the motor 8 and power supply 16, respectively, and can take various constructions as above-mentioned. In this embodiment, it is also assumed that the motor 11 is a DC motor and an input DC voltage applied thereto from the power supply 18 is controlled by the ACR 13. Moreover, there are shown a speed reference controller 15 for issuing a speed command for the work rolls, and current detectors 20 and 22 for detecting the load currents of motors 8 and 11, respectively.

This embodiment employs a speed control system for controlling the work roll 2 so as to make its peripheral speed substantially the same as the exit speed of the rolled steel, and a torque-constant control system for controlling the upper work roll 1 on the basis of a torque command representing a rolling torque $\tau_{70}$ required for the work roll 1, which is obtained by subtracting from a rolling torque $\tau$ required for the upper and lower work rolls 1 and 2, as determined in a manner described hereinafter, a rolling torque $\tau_B$ exerted by the lower work roll 2.

The lower work roll 2 is driven by the motor 11 as illustrated. The control system for the motor 11 includes the ACR 13 (or torque control) provided in its minor loop and the ASR 14 provided in its major loop to control the peripheral speed of the roll according to the speed command $S_B$ given from the speed reference controller 15. This speed control itself is substantially not different from that in the conventional rolling, but when the rolling is made at different peripheral speeds, the peripheral speed, $v_2$ of the work roll 2 is made relatively close to the exit speed $V_2$ of the rolled material, where $v_2 \leqq V_2$. The current control by the ACR 13 and the speed control by the ASR 14 are the same as those in the conventional rolling mill. That is, the torque of the motor 11 is basically controlled so as to drive the motor 11 at a speed corresponding to the speed signal $S_B$ given from the speed reference controller 15. For the purpose, there is provided a loop circuit in which a signal indicative of the actual speed of the motor 11 is generated from a tachogenerator (TG) 12 coupled to the motor 12 and negatively fed back to an adder 24 where it is subtracted from the speed signal $S_B$ to produce a difference signal, which in turn controls the output $\tau_B$ of the ASR 14. The ACR 13 serves to control the output voltage of the power supply 18 applied to the motor 11 so as to make the torque of motor 11 or load current of the motor 11 equal to a value corresponding to the output signal $\tau_B$ given from the ASR 14. For the purpose, there is provided a loop circuit in which an output signal from the detector 22 for detecting the load current of the motor 11 is negatively fed back to an adder 26 where it is subtracted from the signal $\tau_B$ to produce a difference signal, which in turn controls the output of the ACR 13.

The motor 8 for driving the work roll 1 is controlled in its speed and torque by the voltage from the power supply 16. The motor 8 is controlled in its speed by an automatic speed controller (ASR) 30 which modifies the speed command from the speed reference controller 15 to a suitable speed command adapted to drive the upper work roll 1 at a desired peripheral speed. The speed command modified by this ASR 30 is used to control the speed of the upper work roll 1 until the ratio of the peripheral speed of the upper work roll 1 to that of the lower work roll 2 reaches a desired value at the beginning of rolling operation as will be described later. The ASR 30 compares the modified speed command with an output of a tachogenerator 17 representing the rotation speed of the motor 8 and produces an output representing a difference therebetween. The output signal from the ASR 30 is supplied through the ACR 9 to the power supply 16, and thereby controls the output voltage of the power supply 16 so as to make the speed of the motor 8 substantially equal to the modified speed command. After the peripheral speed ratio reaches a desired value, the torque calculating circuit 10 produces the torque signal $\tau_{T0}$, which is supplied to an adder 28 where the current signal supplied from the current detector 20 of motor 8 is subtracted from the torque signal $\tau_T$ to produce a difference signal, which is supplied to the ACR 9 for controlling the output voltage of the power supply 16.

There are various methods for accelerating the upper and lower work rolls 1 and 2 from the rest condition to respective speeds at a desired ratio of peripheral speeds for the normal different peripheral-speed rolling operation. One of the methods is as follows. During the acceleration, the speed controller 30 is set not to modify the output from the speed reference controller 15 thereby accelerating the upper and lower work rolls 1 and 2 with their peripheral speeds equal to each other. After a predetermined speed is reached, the speed controller 30 is manually or automatically adjusted to modify the output of the speed reference controller 15 thereby decreasing the speed of the motor 8 until the peripheral speed of the upper work roll 1 is reduced to a desired value for the different peripheral-speed rolling condition. In another method, the speed controller 30 is initially adjusted to modify the output of the speed reference controller 15 to obtain a modified speed command corresponding to a rotating speed of the motor 8 providing a desired ratio of peripheral speeds of upper and lower work rolls, and then the work rolls are accelerated. This invention is not concerned with how to accelerate, but with how to control the rolling mill after the different peripheral-speed rolling condition is attained with the desired peripheral speed ratio between the upper and lower work rolls, and therefore the acceleration will not be described in detail.

The control system for controlling the motor 8 in the different peripheral speed rolling condition is formed of the torque calculating circuit 10 and the ACR 9 for controlling the motor 8 to produce a torque corresponding to the torque command $\tau_{T0}$ given from the torque calculating circuit 10. That is, the upper work roll 1 is not controlled to keep constant the ratio of the peripheral speed of the upper work roll 1 to the peripheral speed $v_2$ of the lower work roll 2. In this embodiment, the torque $\tau_{T0}$ is calculated from the difference of the torque $\tau_B$ of the roll 2 relative to the total torque $\tau$ required for rolling the material to a desired thickness at a selected speed and used as a torque command for controlling the torque of the roll 1 at the constant torque control mode. The total torque $\tau$ may be theoretical value calculated according to the known rolling theory from the characteristics of the rolling mill, the entry and exit thicknesses of the rolled material, the rolling load and so on, or may be a measured value of the total torque at the normal equal peripheral-speed rolling condition immediately after the upper and lower rolls have been accelerated to a predetermined speed.

Figure 2:
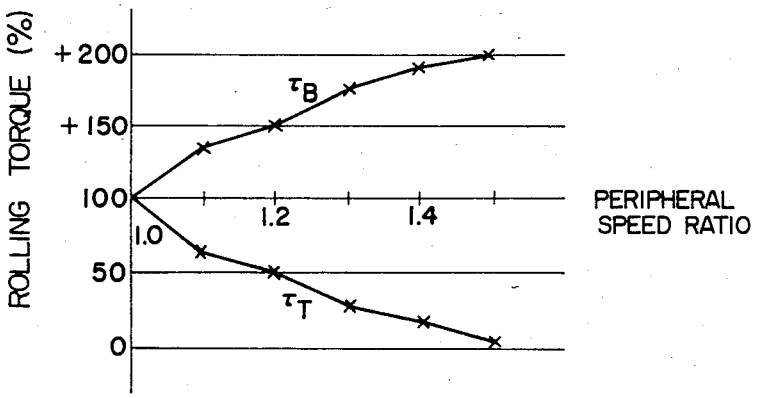
FIG. 2 is a graph of rolling torques of upper and lower rolls with variation of the peripheral-speed ratio in different peripheral-speed rolling.

When the peripheral speed ratio is changed in the different peripheral-speed rolling, i.e., for example, when the lower work roll is accelerated to a higher speed, the torque of the upper work roll 1 is decreased, thus serving as a braking torque. That is, as shown in FIG. 2, as the torque $\tau_B$ of the motor 11 driving the lower work roll 2 is increased, the torque $\tau_T$ of the motor 8 driving the upper work roll 1 is decreased correspondingly according to the law of the constant rolling torque. Strictly speaking, this law is satisfied under the condition that there is no change of parameters affecting the total torque required for rolling, or that there is no disturbance such as change of entry thickness of the rolled material, variation of quality of the rolled material and variation of temperature. Therefore, the rolling torque $\tau$ may be changed. FIG. 2 shows variations of the rolling torques $\tau_T$ and $\tau_B$ of the upper and lower work rolls 1 and 2 as the peripheral speed ratio is increased from 1.0 (the peripheral speeds of both rolls are equal). When the upper and lower rolls 1 and 2 are rotated at equal speed, the torques thereof are equal. If the torque at equal peripheral speed is taken as 100%, the $\tau_B$ at a peripheral speed ratio of 1.4 is about 180% and the $\tau_T$ at the same ratio is about 20%. Thus, if the torque $\tau_T$ of the motor 8 is decreased less than the torque $\tau_B$ and up to the braking torque, the peripheral speed ratio can be greatly changed. Since the rate is change of torque is much larger than the rate in change of peripheral speed ratio, the control precision can be increased by torque-based control rather than by direct control of peripheral speed ratio.

Thus, by contolling one of the rolls (the roll to be rotated at high speed) for its speed and controlling the other roll under the constant torque control mode on the basis of the torque command $\tau_{T0}$ which is determined so as to make the total torque produced by the upper and lower rolls at a value of torque required for the rolling operation at the given conditions, the control range can be widened and the control precision improved, thus enabling the rolling to be more stablized.

Figure 3:
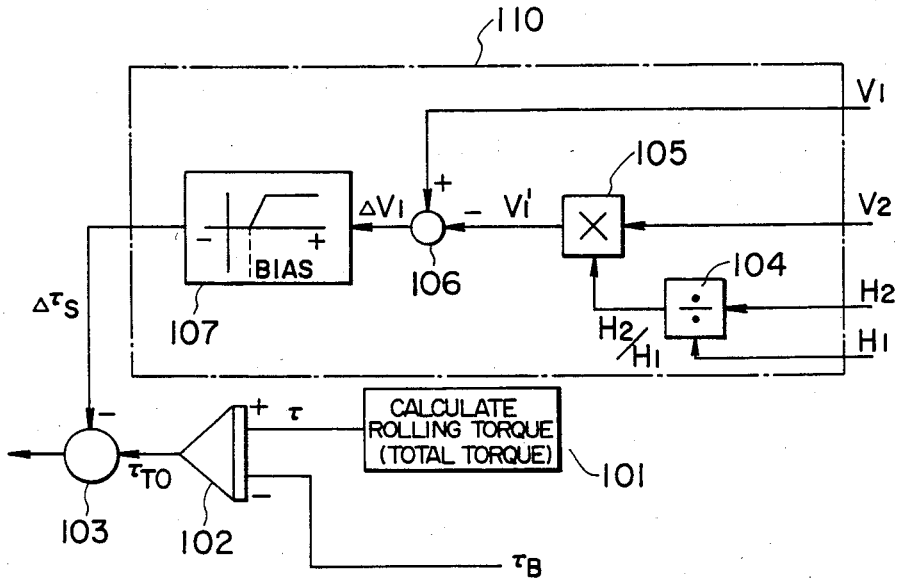
FIG. 3 is a block diagram of a torque setting circuit.

The torque calculating circuit 10 in the embodiment of FIG. 1 will be described in more detail. FIG. 3 is a block diagram of the torque calculating circuit 10. In FIG. 3 there are shown a rolling torque calculating section 101 for calculating the total rolling torque $\tau$ required for the rolling operation, and an adder 102 for calculating the difference $\Delta_{T0}$ between the output $\tau$ of the rolling torque calculating section 101 and the rolling torque $\tau_B$ produced by the roll 2. This $\tau_{T0}$ is supplied through an adder 103 to the ACR 9 in FIG. 1 as a control command (torque command).

The rolling torque calculating section 101 may be arranged to calculate the total torque according to the known rolling theory in the equal peripheral speed rolling operation on the basis of the rolling conditions such as characteristics of rolling mill, the entry and exit thickness of the rolled material, the rolling load, and the hardness of the rolled material or to calculate the total torque from the load currents of the motors when the equal peripheral speed rolling condition is brought about upon accelerating the upper and lower rolls 1 and 2 to a predetermined speed.

Normally, it is enough to control the torques of the upper and lower rolls 1 and 2 as described above. However, if a slip occurs between the rolled material and the upper roll under the constant torque control, the rolling operation may become unstable. Therefore, it is desired to provide means for limiting the upper roll speed so as to prevent the upper roll from deviating from a speed range where the rolling operation is maintained stable. A speed limiting circuit 110 is provided for this purpose. The speed limiting circuit 110 includes a divider 104 for calculating the ratio $H_2/H_1$ of the exit thickness $H_2$ to the entry thickness $H_1$ of the rolled material, and a multiplier 105 for multiplying the output of the divider 104 by an exit speed $V_2$ of the rolled material to produce an output indicating $$V_1' = V_2 \times H_2/H_1.$$

When the normal rolling operation is made with no slip occuring at the upper roll and when the exit and entry thickness of the rolled material are substantially equal to set values, the following relationship can be established according to the law of constant mass-flow $$V_1 \times H_1 = V_2 \times H_2.$$

Figure 4:
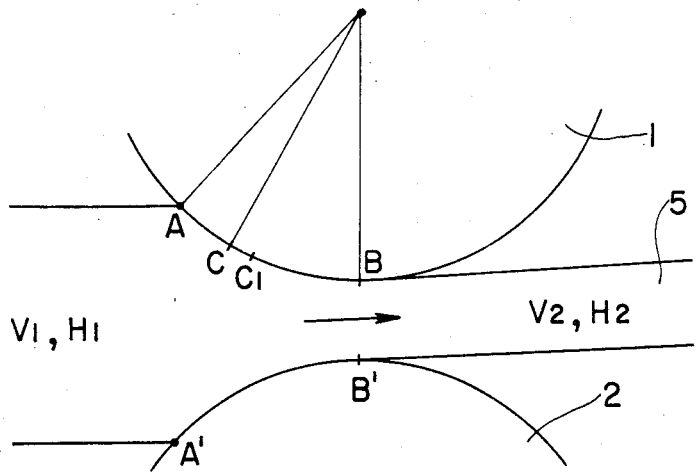
FIG. 4 is an explanatory diagram useful for explaining the relation between the peripheral speed of each roll and the speed of the rolled material in different peripheral-speed rolling.

Thus, $V_1 = V_1'$ is established. The value $V_1$ can be considered as a target value for the peripheral speed of the upper work roll 1 in the normal different peripheral-speed rolling, and the value $V_1'$ is regarded as an actual speed obtained according to the law of constant mass-flow. When the upper work roll 1 slips, the peripheral speed of the upper work roll 1 is deviated from the target value $V_1$, or becomes smaller than target value ($V_1 > V_1'$). An adder 106 adds $V_1$ to $(-V_1')$ to produce $\Delta V_1 = V_1 - V_1'$. A function generator 107 produces a torque signal $\Delta\tau_S$ as a function of $\Delta V_1$. The relation between $\Delta V_1$ and $\Delta\tau_S$ will be described with reference to FIG. 4. FIG. 4 is an enlarged view of part of the upper and lower work rolls 1 and 2 and the rolled material 5 shown in FIG. 1. The rolled material 5 is rolled when it passes from position AA' to BB' between the upper and lower work rolls 1 and 2, and as a result, its thickness is reduced from $H_1$ to $H_2$. On the other hand, the speed of the material in the rolling direction is gradually increased from the entry-speed $H_1$ to the exit-speed $H_2$. In the normal equal peripheral speed rolling, the peripheral speeds of the upper and lower rolls 1 and 2 are equal to the speed of the material at a position close to BB'. On the different peripheral speed rolling, the peripheral speed of the lower work roll 2 is the same as in the equal peripheral speed rolling, but the peripheral speed of the upper work roll 1 becomes equal to the speed of the rolled steel at a point C, or neutral point C between A and B. As the peripheral speed ratio increases, the point C approaches to the point A. Since the speed of the rolled steel at point A is $V_1$, the peripheral speed of the upper work roll 1 in the different peripheral speed rolling lies between $V_1$ and $V_2$. When point C lies between A and B, stable rolling is effected, but when a slip occurs, the peripheral speed of the upper work roll becomes slower than that of the rolled steel at point A. In order to prevent this, the torque command to the upper roll 1 is decreased by $\Delta\tau_S$ when the neutral point C is deviated from the stable range of A to B, by a predetermined value. The value $\Delta V_1$ is zero when the neutral point C of the upper work roll 1 is at A, and the value $\Delta V_1$ gradually increases as the neutral point C is deviated from A. The $\Delta\tau_S$ is determined to be zero until the neutral point C is deviated from the point A by a value not larger than a predetermined value and to linearly increases as the deviation of the neutral point C from the point A exceeds the predetermined value. The upper limit of $\Delta\tau_S$ is selected to be about the maximum allowable torque of the motor 8, e.g., 175 to 225% of the motor capacity, while $\Delta\tau_S$ is selected to be zero when the $\Delta V_1$ is about 10% or below of the target value of $V_1$.

The output $\Delta\tau_S$ of the function generator 107 is supplied as a torque compensation signal to the adder 103. The output, $\tau_{T0} - \Delta\tau_S$ of the adder 103 is fed to the ACR 9 as a torque command signal for controlling the DC voltage to be supplied to the motor 8 from the power supply 16, thereby controlling the torque of the upper work roll drive motor.

While in the above embodiment, the values of $H_1$ and $H_2$ are measured values, they may be set values.

We claim:

1. A control apparatus for controlling at least a pair of rolls of a rolling mill for rolling a material to be rolled by passing said material through a pressure gap defined between said rolls, said apparatus comprising:

a pair of motors connected to respective work rolls;

speed control means connected to one of said motors and controlling the speed of said one of said motors driving one of said rolls so as to drive said one roll at a predetermind peripheral speed;

first means connected to said one roll for determining and outputting a signal representing an actual torque produced by said one roll;

second means for determining and outputting a signal representing a total torque required for rolling said material under a predetermined rolling condition;

third means connected to the output of said first and second means for producing a torque signal representing a difference between said total torque determined by said second means and said actual torque of said one roll determined by said first means; and fourth means connected to said third means and said other roll for controlling a current of the other of said motors for driving said other roll so as to cause said other roll to produce a torque corresponding to said torque signal.

2. A control apparatus according to claim 1, further including means connected to said third and fourth means for correcting said torque signal so as to increase the peripheral speed of said other roll when the peripheral speed of said other roll decreases a predetermined value below a desired speed of said other roll determined according to the predetermed rolling condition.

3. A control method for controlling at least a pair of rolls of a rolling mill for rolling a material to be rolled by passing said material through a pressure gap defined between said rolls, a pair of motors being connected to respective work rolls, said method comprising the steps of:

controlling the speed of one of said motors connected to one of said rolls for driving said one of said rolls at a predetermined peripheral speed;

determining an actual torque produced by said one roll and outputting a signal representative thereof;

determining the total torque required for rolling said material under a predetermined rolling condition and outputting a signal representative thereof;

producing a torque signal in accordance with a difference between said total torque signal and said actual torque signal of said one roll; and controlling the other of said motors for driving said other roll so as to cause said other roll to produce a torque corresponding to said torque signal.

4. A control method according to claim 3, further comprising the step of correcting said torque signal so as to increase the peripheral speed of said other roll when the peripheral speed of said other roll decreases a predetermined value below a desired speed of said other roll determined according to the predetermined rolling condition.

5. A control method according to claim 3, wherein the step of determining the total torque required under the predetermined rolling condition includes one of calculating the total torque required and utilizing the results of rolling in a prior actual rolling operation.

6. A control method according to claim 3, wherein said step of controlling said other of said motors includes controlling a current of said other of said motors.

* * * * *